US005715838A

United States Patent [19]

Dyett

[11] Patent Number: 5,715,838

[45] Date of Patent: Feb. 10, 1998

[54] CIGARETTE MANUFACTURE

[75] Inventor: Derek Henry Dyett, High Wycombe, United Kingdom

[73] Assignee: Molins PLC, Miltonkeynes, United Kingdom

[21] Appl. No.: 675,067

[22] Filed: Jul. 3, 1996

[30] Foreign Application Priority Data

Jul. 5, 1995 [GB] United Kingdom ..... 9513697

[51] Int. Cl.[6] ..... A24C 5/00; A24C 5/32

[52] U.S. Cl. ..... 131/94; 131/282

[58] Field of Search ..... 131/94, 84.1–84.4, 131/907, 910

[56] References Cited

U.S. PATENT DOCUMENTS 4,570,643 2/1986 Seragnli ..... 131/94

4,745,932 5/1988 Mattei et al. .

5,044,379 9/1991 Cahill et al. ..... 131/910 X 5,349,968 9/1994 Rizzoli et al. ..... 131/94

*Primary Examiner*—Vincent Millin

*Attorney, Agent, or Firm*—Antonelli, Terry, Stout, & Kraus, LLP

[57] ABSTRACT

A filter attachment machine for use with a twin-track cigarette making machine is arranged to receive, in alternate flutes of a fluted drum (10), the cigarette rods from the respective tracks of the cigarette making machine, and to convey the cigarette rods from alternate flutes to separate filter assembly devices (38;40) by which filters are attached to the cigarette rods. The machine preferably receives the cigarette rods in one row on the fluted drum (10), and includes separation drums (28;36) arranged to feed the cigarette rods from alternate flutes to upper and lower filter attachment devices (38;40) lying in substantially the same vertical plane.

7 Claims, 1 Drawing Sheet

CIGARETTE MANUFACTURE

This invention is concerned with machines for attaching filters to cigarettes. It is particularly, though not exclusively, concerning with a filter attachment machine for use with a twin track cigarette making machine. Such cigarette making machines have become available in recent years and are capable of producing a high output (for example, in excess of 14,000 cigarettes per minute), and the present invention is concerned with a filter attachment machine for coping with outputs of that order and higher.

An example of a twin track cigarette making machine is described in patent specification GB 2053654 and also in our British patent applications Nos. 9425979.3 and 9512938.3.

According to one aspect of the present invention, a filter attachment machine for use with a twin-track cigarette making machine is arranged to receive, in alternate flutes of a fluted drum, the cigarette rods from the respective tracks of the cigarette making machine, and is arranged to convey the cigarette rods from alternate flutes to separate assembly devices by which filters are attached to the cigarette rods.

The fluted drum preferably receives the cigarette rods in a single row (i.e., with their centers lying substantially in a common vertical plane), and includes separation drums which feed the cigarette rods from alternate flutes to upper and lower filter assembly devices lying in substantially the same vertical plane. Thus both filter assembly devices can be made readily accessible.

This invention enables filter assembly to be carried out at half the speed that would apply if all the cigarette rods were handled by a single filter assembly device. Moreover, a preferred machine according to this invention has one or more of the following features:

(a) If disruption (e.g. a jam) occurs in one of the filter assembly devices, the other device is able to continue on its own, either temporarily until the disruption is cleared, or for a prolonged period, in which case the maker track corresponding to the disrupted filter assembly device could be arranged to stop operating.

(b) Following assembly of filters to the cigarette rods (usually a double length filter being joined between two halves of the initially formed double cigarette rod), the cigarette/filter assemblies from the two assembly devices may be brought together on a common fluted drum and preferably continue in that way through a cigarette inspection device, but a computer or other control system for the machine nevertheless distinguishes between the cigarettes coming from the respective maker tracks and the respective filter assembly devices. Thus any cigarettes found to be faulty, either by a rod scanning device in the cigarette making machine or by the cigarette inspection device, can be ejected with note being taken by the computer as to which maker track produced each defective cigarette; accordingly separate statistics can be produced for the two tracks.

(c) If the cigarette making machine is capable of running one track without the other, the cigarette rods produced in that way can preferably be handled by the filter attachment machine, the supply of filters and filter assembly paper for the inoperative track being discontinued until both maker tracks are again in operation. For this purpose, filter rods are preferably supplied for the cigarettes of the respective maker tracks by separate filter feeding arrangements.

According to another aspect of the present invention, a filter assembly machine includes a fluted drum arranged to receive all the cigarette rods from an associated cigarette making machine, and cigarette rods from alternate flutes are fed from the first drum via separate fluted drums leading to separate filter assembly devices. After assembly, the cigarette/filter rods are preferably fed to a common fluted drum so as to be conveyed together in alternate flutes of that drum.

An example of a filter assembly machine according to this invention is shown diagrammatically in the accompanying drawings. In these drawings.

Figure 2:
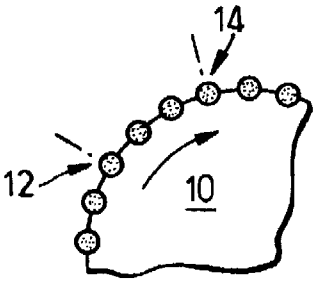
FIG. 2 is an enlargement of part of the first fluted drum in the region where cigarette rods are received by it.

The machine shown in the drawings includes a catcher drum 10 which is intended to receive cigarettes, in this example, from a twin track cigarette making machine arranged to deliver double length cigarette rods onto the drum at positions 12 and 14 shown in FIG. 2 to form a single row of cigarette rods. Preferably the delivery of cigarette rods is achieved by means of pairs of cam devices such as are described in our British patent No. 2149642. However, the cigarette rods may alternatively be delivered onto the catcher drum 10 by orbiting devices which grip the axially moving pairs of rods and deliver them with the appropriate lateral motion of travel onto the drum 10.

The flute pitch of the drum 10 is, for example, 13 mm. As shown in FIG. 2, the delivery positions 12 and 14 are spaced apart by three flute pitches. Each delivery of a pair of parallel cigarette rods onto the drum 10 occurs after the drum 10 has advanced through two flute pitches. Thus the drum 10 receives rods from the two maker tracks in alternate flutes.

It is assumed for the purpose of this example that the rods received from the maker are double length rods. Accordingly, the cigarette rods are received from the drum 10 by a fluted drum 16 and, while being carried by that drum, are cut in half by a disc knife 18. While travelling on further fluted drums 20 and 22, the two halves of each cigarette rod are moved apart to allow double filter portions to be placed between them while they are being carried by a further drum 24. The double filter portions are delivered onto the drum 24 via drums 26 and 28, being received by the drum 26 from separate feeder drums 30 and 32 which deliver filter rods into alternate flutes of the drum 26 to form a single row. The drums 30 and 32 each form part of a filter feed including drums 31 and 33 which receive multiple-length filter rods from filter hoppers (not shown), and intermediate drums (30A,30B and 32A,32B) as shown. While travelling from the initial drum 31 or 33, each multiple-length filter rod is cut into double filter portions in any well known manner (for example, as described in our British patent 2001841) and these double filter portions are fed as aligned rows into alternate flutes of the drum 26.

Each flute of the drum 24 (the flutes being at 13 mm pitch, as will be further explained) thus receives a rod group comprising two axially spaced cigarette portions and an interposed double length filter portion. The rod groups from alternate flutes are then received by separating drums 34 and 36 for delivery to separate filter assembly devices 38 and 40 each of which may be of known construction, for example as described in our British patent 1526394.

The filter assembly device 38 comprises a generally smooth-surfaced drum 42 formed with suction passages for gripping and feeding a web 44 of filter assembly paper. This web moves past a gum roller 46 which applies a pattern of adhesive to the upper surface of the web, and then passes over a heated plate 48 before being delivered tangentially onto the drum 42. A rotating knife 50 cuts the web into individual portions which are then conveyed, spaced apart from one another, on the surface of the drum 42 and towards a rolling member 52. Cigarette/filter groups are applied to the leading edges of successive portions of gummed paper as they enter the gap between the rolling member 52 and the drum 42, and each cigarette/filter group is thus rolled so as to wrap the paper around it to form a double filter cigarette.

A further fluted drum 54 receives the double filter cigarettes in alternate flutes, and receives similar double filter cigarettes in the other flutes from a fluted drum 56. Double filter cigarettes are received by the drum 56 from the filter assembly device 40 which is essentially a mirror image of the filter assembly device 38 and will not be separately described.

The fluted drum 54 has flutes at a 13 mm pitch which are alternately deep and shallow. The deep flutes receive the double cigarette assemblies from the fluted drum 56, while the intermediate shallow flutes receive the double filter assemblies from the upper filter assembly device 38. During transfer to successive fluted drums 58 and 60, the flute depths are progressively equalized. Thus the drum 60 has flutes (at 13mm pitch) of uniform depth. A further disc knife 62 cuts the double filter cigarette assemblies through the middle to form individual filter tipped cigarettes which are further conveyed by drums 64, 66 and 68 to a cigarette inspection drum 70 on which all the cigarettes are pneumatically tested. The cigarette inspection device may be as described in our British patent No. 2050804.

While being conveyed by a further fluted drum 72, any cigarettes found to be defective by the cigarette inspection device or by the rod scanning device in the associated cigarette making machine may be automatically ejected, the movement of defective cigarettes being tracked by the control computer (not shown) in an essentially well-known manner.

While being conveyed by the drum 66, the filter tipped cigarettes are moved apart axially to enable the paper web 74 for the lower filter assembly device to pass between them via a peripheral groove in the drum 68.

Figure 1:
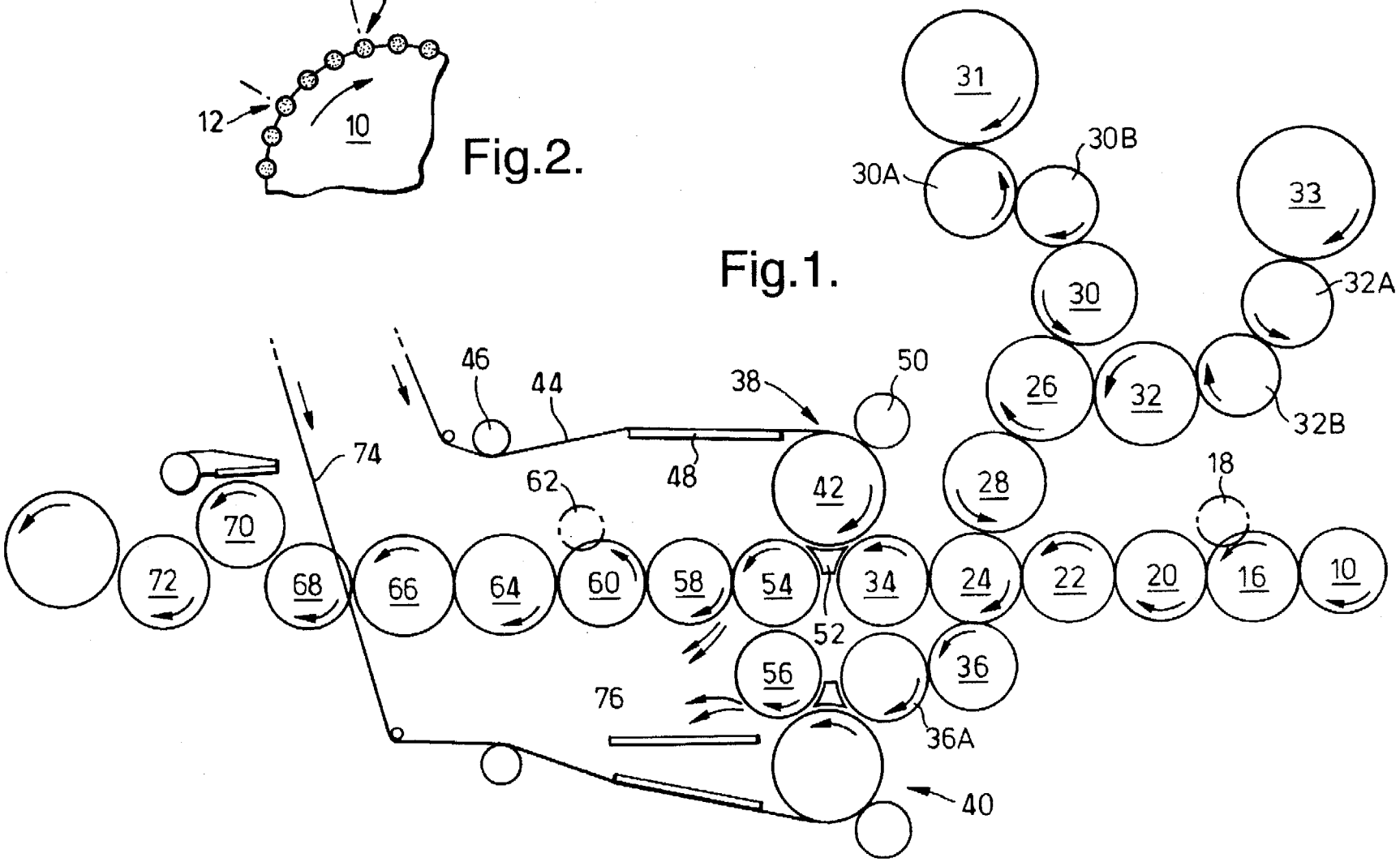
FIG. 1 is an overall front view of the machine.

In this example, all of the fluted drums shown in FIG. 1 have a flute pitch of 13 mm, apart from drums 30, 30A, 30B, 31,32, 32A, 32B, 33, 34, 36, 36A and 56. These last drums have twice the pitch of the other drums, namely 26 mm in this particular example.

Each of the 13 mm pitch drums has an even number of flutes with separate suction supply passages to alternate flutes. This has the purpose of ensuring that while one maker track is inoperative, so that the flutes intended to receive the cigarette and filter rods for that track are empty, this will not result in a loss of suction to the other flutes.

A conveyor 76 moving parallel to the drum axes is provided to carry away waste (defective rod assemblies) produced by both assembly devices while the machine is being started. Arrows adjacent to the drums 54 and 56 show the discharge of such waste.

I claim:

1. A filter attachment machine for producing filter-tipped cigarettes comprising a first fluted drum arranged to receive rod groups each comprising axially aligned cigarette rods with an interposed double-length filter rod; a second fluted drum arranged to receive the rod groups from alternate flutes of the first fluted drum; a third fluted drum arranged to receive the other intermediate rod groups from the first fluted drum; first web feed means for feeding a web of filter attachment paper past first adhesive application means and towards first web cutting means arranged to cut the first adhesive-coated web into separate sheets for joining the rods of the first rod groups; second web feed means for feeding a web of filter attachment paper past second adhesive application means and towards second web cutting means arranged to cut the second adhesive-coated web into separate sheets for joining the rods of the second rod groups; first rod rolling means for rolling the first rod groups while at the same time wrapping each successive adhesive-coated sheet from the first web feed means around a double filter rod of the first rod group, with the edges of the sheet overlapping the adjacent ends of the corresponding cigarette rods to form a double filter cigarette; second rod rolling means for rolling the second rod groups while at the same time wrapping each successive adhesive-coated sheet from the second web feed means around a double filter rod of the second rod group, with the edges of the sheet overlapping the adjacent ends of the corresponding cigarette rods to form a double filter cigarette; the distances between each of the first and second adhesive application means and the respective first and second rod rolling means being substantially the same; and a fourth fluted drum arranged to receive the double filter cigarettes from the respective first and second rod rolling means in successive flutes therein and to convey all the assembled double filter cigarettes in a single line towards cutting means for cutting the double filter cigarettes midway between their ends to produce aligned pairs of individual filter tipped cigarettes.

2. A machine according to claim 1, in which the assembled rods are fed from the fourth fluted drum to a common cigarette inspection device.

3. A machine according to claim 2, wherein said first fluted drum is arranged to receive cigarette rods produced by the two tracks of a twin-track cigarette making machine, and further including a control system for distinguishing between cigarettes of the two cigarette maker tracks when found to be faulty by said cigarette inspection device, and for indicating to the operator the occurrence of faults from the two tracks of the cigarette making machine.

4. A machine according to claim 1, in which double-length filter rods are delivered to the first fluted drum by separate filter rod feeding arrangements, one of which feeds double-length filter rods into alternate flutes of the first fluted drum, and other of which feeds double-length filter rods into the other intermediate flutes of the first fluted drum.

5. A machine according to claim 4, wherein said first web feed means, said first rod rolling means, and one of said filter rod feeding arrangements comprise a first double filter assembly line, while said second web feed means, said second rod rolling means and the other filter rod feeding arrangement comprise a second double filter assembly line, said first and second double filter assembly lines being operable independently so that one is capable of operating while the other is inoperable.

6. A machine according to claim 5, wherein said first fluted drum has an even number of flutes and first and second suction supply passages respectively connected to alternate flutes.

7. A filter attachment machine according to claim 1, in which each rod rolling means comprises a drum and a corresponding rolling plate for rolling the rod groups with respect to the drum, and in which the corresponding web cutting means cooperates with the said drum for cutting the corresponding web into the said separate sheets.

* * * * *